United States Patent [19]

Croucher et al.

[11] Patent Number: 4,766,049

[45] Date of Patent: Aug. 23, 1988

[54] LATEX BASED COLORED LIQUID DEVELOPERS

[75] Inventors: Melvin D. Croucher, Oakville; Raymond W. Wong; James M. Duff, both of Mississauga; Michael L. Hair; John R. C. Fuller, both of Oakville, all of Canada

[73] Assignee: Xerox Corporation, Stamford, Conn.

[21] Appl. No.: 2,045

[22] Filed: Jan. 9, 1987

[51] Int. Cl.[4] ..... G03G 9/18

[52] U.S. Cl. ..... 430/115; 430/119

[58] Field of Search ..... 430/114, 115, 137, 119

[56] References Cited

U.S. PATENT DOCUMENTS

| | | | |
|---|---|---|---|
| 3,383,209 | 5/1968 | Cassiers et al. | 96/1.3 |
| 3,441,426 | 4/1969 | Van Den Heuvel et al. | 117/37 |
| 3,772,012 | 11/1973 | Whittaker | 96/1 LY |
| 3,907,695 | 9/1975 | Amidon et al. | 252/62.1 |
| 3,985,663 | 10/1976 | Lu et al. | 252/62.1 L |
| 4,197,211 | 4/1980 | Amidon et al. | 430/115 |
| 4,202,913 | 5/1980 | Klavan et al. | 430/106 |
| 4,245,023 | 1/1981 | Cassiers et al. | 430/118 |
| 4,268,597 | 5/1981 | Klavan et al. | 430/102 |
| 4,476,210 | 10/1984 | Croucher et al. | 430/115 |
| 4,497,886 | 2/1985 | Herrmann et al. | 430/115 |

*Primary Examiner*—John L. Goodrow

*Attorney, Agent, or Firm*—E. O. Palazzo

[57] ABSTRACT

Disclosed is a colored liquid developer composition comprised of an insulating oil base, a stabilized polymer latex component with imbibed molecularly dispersed colored dye components, and a thickener compatible with the stabilizer selected for the latex.

31 Claims, No Drawings

LATEX BASED COLORED LIQUID DEVELOPERS

BACKGROUND OF THE INVENTION

This invention is generally directed to liquid developer compositions, especially colored liquid developers with rapid drying times, and excellent image fixing characteristics. More specifically, the present invention is directed to colored liquid developer compositions comprised of an oil base, a sterically stabilized latex component, and other additives, inclusive of thickeners. Thus, in one important embodiment of the present invention there are provided liquid inks with rapid drying times, less than 40 seconds for example, and excellent image fixing characteristics, which inks are comprised of a Magiesol-isopar oil base or oil base mixture, a dyed latex of poly(vinyl pyrrolidone-co-ethylacrylate) sterically stabilized with a soluble polymer, inclusive of polyisobutylene, or poly(styrene-b-ethylene butylene) block copolymer, and a thickener component. In a further embodiment of the present invention there are provided liquid ink compositions comprised of an oil base component, a sterically stabilized latex component dyed with a cyan, magenta, or yellow dye, or mixtures thereof; and a thickener component. The liquid inks of the present invention can be selected for the development of images in various processes including the liquid development process as described in U.S. Pat. No. 3,084,043, the disclosure of which is totally incorporated herein by reference; xerographic processes, electrographic recording, electrostatic printing, and facsimile systems.

Liquid developer compositions are known, reference for example U.S. Pat. No. 3,806,354, the disclosure of which is totally incorporated herein by reference. This patent illustrates liquid inks comprised of one or more liquid vehicles, colorants, such as pigments, dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as alkylated polyvinyl pyrrolidone. Additionally, there is described in U.S. Pat. No. 4,476,210 electrostatically charged liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof. Also of interest are the liquid inks disclosed in U.S. Pat. Nos. 4,004,931 and 4,268,597, see columns 13, 23 and 24, wherein an ink developer with a dye dissolved in an oil vehicle is illustrated. A similar teaching is presented in U.S. Pat. No. 3,772,012, see columns 7 and 8; U.S. Pat. No. 3,985,663, see columns 3, 4, 5 and 9; and U.S. Pat. No. 4,202,913, see columns 7, 15 and 17.

In addition, there is disclosed in U.S. Pat. No. 4,197,211 an ink composition having suspension of colored resin particles, reference columns 5, 6, 7 and 10; and in 4,245,023 there is described a process for the development of electrostatic images on dielectric paper, reference column 7, and note the general statement in column 8 that the developing liquid may be a solution or a suspension. Moreover, the use of vinyl pyrrolidones and ethylacrylates in developers is illustrated in U.S. Pat. Nos. 4,497,866, see the Abstract of the Disclosure; 3,383,209, see column 18; 3,441,426, see column 4; and 3,907,695. References of general background interest include U.S. Pat. Nos. 3,372,027; 3,486,922; 3,954,640; 4,024,292; and 4,062,789. These references, however, do not teach a colored liquid developer composition with an insulating oil base, a stabilized latex component with imbibed molecularly dispersed colored dyes, and a thickener.

Although the above described liquid inks are suitable for their intended purposes, there remains a need for new liquid developers. More specifically, there is a need for colored liquid developers with improved drying times, excellent image fixing characteristics, desirable conductivity values, and which exhibit time independent non-Newtonian rheological properties. Additionally, there is a need for submicron colored liquid developer compositions that permit images of excellent resolution in a number of known imaging processes, including those illustrated in U.S. Pat. No. 3,084,043. Moreover, there is a need for liquid developers wherein the dyes selected are suitably dispersed thus enabling colored images of excellent resolution. Further, there remains a need for colored latex liquid developers wherein there are included therein other additives including thickeners, and wherein these developers have a desirable conductivity of from about $10^9$ to about $10^{11}$ $(\text{ohm-cm})^{-1}$. There also is a need for colored latex liquid inks which are useful with dielectric papers. Moreover, the dye latex ink particles of the present invention are essentially of a neutral polarity and oil based liquids as contrasted, for example, with pigments which often charge when placed in oils. Accordingly, with the conductive liquid inks of the present invention with neutral polarities thereon images of either a positive or negative charge can be developed. In addition, there is a need for liquid developers with a latex of a soft or hard component thereby enabling the thermal mechanical properties to be selected as desired enabling, for example, acceptable fixing characteristics. There is also a need for colored liquid inks wherein the polymer particles can be dyed to any desired color. Also, there is a need for liquid inks that are thermal dynamically stable, that is for example they do not flocculate on standing; and further, there is a need for inks with extended shelf life for periods exceeding six months.

SUMMARY OF THE INVENTION

It is an object of the present invention to provide improved colored, including black, liquid developer compositions.

In another object of the present invention there are provided colored liquid developer compositions which can be selected for use in several different imaging systems, and which inks may also be used with dielectric papers in certain situations.

In yet another object of the present invention there are provided colored liquid developer compositions with rapid drying times, and excellent image fixing characteristics.

It is an additional object of the present invention to provide colored liquid developer compositions of a submicron size.

Furthermore, in another object of the present invention there are provided colored liquid developer compositions with cyan, magenta, or yellow latex particles.

Additionally, in another object of the present invention there are provided colored latex liquid developer compositions imbibed with cyan, magenta, or yellow dyes, and mixtures thereof thus enabling black, red, or green developer mixtures.

Another object of the present invention resides in colored liquid developer compositions that can be consistently prepared by a simple, and economical process.

Furthermore, in another object of the present invention there are provided liquid ink compositions with a viscosity of from about 100 to about 1,000 centipoises, and preferably from about 200 to 300 centipoises, which viscosities remain relatively constant at a temperature between about 10° to about 32° C.

These and other objects of the present invention are accomplished by providing colored liquid developer compositions. More specifically, in one embodiment the present invention is directed to colored liquid developer compositions with rapid drying times, and excellent image fixing characteristics comprised of an oil base dispersion component of, for example Magiesol 60, Witsol 50, Shellflex 210, Paraflex HT-10, Parabase, Isopar, or mixtures thereof; a dyed sterically stabilized latex component, and a thickener compatible with the stabilizer selected for the latex. Therefore, in one specific embodiment of the present invention there are provided colored liquid developer compositions comprised of from about 40 percent to about 90 percent by weight of an insulating oil base component, from about 5 percent to about 50 percent by weight of a dyed sterically stabilized latex containing an insoluble polymer such as poly(vinylpyrrolidone-co-ethyl acrylate), or other particulate polymers indicated herein; and from about 1 percent by weight to about 40 percent by weight of a thickener comprised of, for example, a polymer or a colorless pigment. In addition, the liquid developer compositions of the present invention may also include therein as optional components materials which function as conductivity additives, which additives are present in an amount of from about 0.5 percent by weight to about 3 percent by weight.

Examples of oil base vehicle components present in an amount of from about 40 percent by weight to about 90 percent by weight, and preferably present in an amount of from about 50 percent by weight to about 80 percent by weight, include insulating dispersion mediums with a resistivity of greater than about $10^9$ ohm-cm, and a viscosity less than about 10 centipoises, including aliphatic hydrocarbons, such as Magiesol 60 primarily because of its low viscosity, about 10 centipoises at 25° C., and low vapor pressure, substantially zero, which is commercially available from Magie Oil, Inc., Illinois; Shellflex 210, available from Shell Chemical Company; Paraflex HT-10, available from Gulf Inc. of Canada; Parabase, available from Shell Chemical Company; Witsol 50, available from Witco Inc.; Isopar G, H, L, and M, available from Exxon Chemical; and the like. The aforementioned oil, especially the Magiesol 60, are particularly useful in the present invention since they are colorless and absorb rapidly into various papers inclusive of Xerox 4024 paper. Preferred for the colored liquid developers of the present invention are Magiesol 60 present in an amount of from about 10 percent by weight to about 90 percent by weight, and preferably present in an amount of from about 50 percent by weight to about 80 percent by weight; and Parabase present in an amount of from about 10 percent by weight to about 90 percent by weight, and preferably present in an amount of from about 20 percent by weight to about 50 percent by weight. For imaging processes with dielectric papers there is selected as the oil base dispersion a volatile material, such as Isopar. In addition, mixtures of volatiles such as Isopar, about 50 percent by weight, and Parabase, about 50 percent by weight, are particularly useful since they permit drying to be more rapidly achievable as the volatile material evaporates more quickly, while the nonvolatile Magiesol component is absorbed into the paper. In the aforementioned situation, the drying times can be from about 10 to about 20 seconds. With further respect to dielectric papers, generally Isopar, or various forms thereof are the only oils selected as they are absorbed onto the paper, while heavy oils such as Magiesol 60 may not be as rapidly absorbed thereon.

Imbibed molecularly dispersed dyes, which are contained in the polymer stabilized latex are present in an amount of from about 2 percent by weight to about 50 percent by weight, and preferably present in an amount of from about 5 percent by weight to about 30 percent by weight. Dyes that can be selected for the developers of the present invention are cyan, magneta, yellow, mixtures thereof, or black dyes, thus enabling for example black, green, or red developers. Illustrative examples of the aforementioned dyes include Orasol Blue GN, Orasol Blue 2GLN, Orasol Yellow 2GLN, Orasol Red G, Orasol Black RL, all available from Ciba-Geigy Corporation; Morfast Blue 100, Morfast Red 101, Morfast Red 104, Morfast Yellow 102, available from Morton Chemicals, Ltd.; Savinyl Yellow RLS, Savinyl Pink 6BLS, Savinyl Red 3BLS, Savinyl Red GL5, Savinyl Black RLS, from Sandox; and Neozapon Black X57 available from BASF. All of these dyes are methanol soluble and are dyed according to the procedure outlined in U.S. Pat. No. 4,476,210, the disclosure of which is totally incorporated herein by reference. Moreover, there can be selected as black dyes the components as illustrated in copending application U.S. Ser. No. 846,164, entitled Black Liquid Developer Compositions, the disclosure of which is totally incorporated herein by reference. Specific examples of the aforementioned black dyes include Orasol Black RL, commercially available from Ciba-Geigy Inc.; Savinyl Black RLS, commercially available from Sandox; or Neozapon Black X57, commercially available from BASF. In addition, the imbibed dyes are incorporated into the latex component of the liquid developer compositions in various suitable effective amounts as indicated herein providing the objectives of the present invention are achieved.

Typical latex core polymer particles that may be selected include poly(N-vinyl-2-pyrrolidone); poly(vinylacetate); poly(ethylacrylate); poly(N-vinyl-2-pyrrolidone-co-ethylacrylate); and the like, reference for example U.S. Pat. No. 4,476,210, the disclosure of which is totally incorporated herein by reference.

Examples of steric stabilizer components present in an amount of from about 1 percent to about 25 percent by weight, calculated on the amount of monomer concentration in the dispersion medium, that is for example the oil base component includes various soluble polymers, providing the objectives of the present invention are accomplished such as Kalene 800, available from Hardman Company of New Jersey, which is a poly(isobutylene-co-isoprene) copolymer; Kraton G-1701, available from Shell Chemical, which is a poly(styrene b-ethylene butylene) block copolymer; and the like, reference for example the steric stabilizers illustrated in U.S. Pat. No. 4,476,210, see particularly column 6, beginning at line 65.

As thickeners there can be selected those components that provide a viscosity for the final colored liquid developers of from about 100 to about 3,000 centipoises, and preferably from about 200 to about 300 centipoises; and that are compatible, that is where the polymer or polymers selected remain in solution with the stabilizer selected for the latex. Examples of polymeric thickeners selected include polyisobutylenes such as Kalene 800, available from Hardman Company, New Jersey; Vistanex, available from Exxon Corporation; ECA 4600, available from Paramins, Ontario; and the like. Additionally, the copolymer Kraton G-1701 can be selected as a thickener. Moreover, it is important with respect to the ink compositions of the present invention that the thickener selected be chemically compatible with the steric stabilizer of the latex since noncompatibility could cause the thickened latex to flocculate irreversibly thereby providing a developer with very short shelf life, that is a few days or less. More specifically, for example, when Kraton G-1701 is selected as the latex steric stabilizer it should also be used as the thickener thereby enabling the ink composition to remain thermodynamically stable. Similarly, when Kalene 800 is selected as the stabilizer, polyisobutylene should be selected as the thickener. Other compatible thickeners include inorganic components such as Aerosil 200, available from Degussa, and Bentone 500, available from N.L. Products.

The aforementioned polymeric thickeners are present in various effective amounts. Generally, however, from about 1 percent by weight to about 30 percent by weight of the polymeric thickness are selected. With regard to the inorganic thickeners such as the Aerosil, they are usually present in the developer composition in an amount of from about 1 percent by weight to about 5 percent by weight.

Characteristics associated with the liquid developers of the present invention include rapid drying times of from about 5 to about 40 seconds as compared to drying times of greater than 1 minute for several prior art colored liquid developer compositions as illustrated herein. Also, the colored developers of the present invention have excellent image fixing characteristics, that is they cannot be removed from the paper subsequent to drying without tearing of the paper surface. Drying time as utilized herein is defined as the time consumed until the image will not smear after exiting from the imaging device.

The liquid developer compositions of the present invention are especially useful for enabling the development of colored electrostatic latent images, particularly those contained on an imaging member charged negatively or positively. Examples of imaging members that may be selected are various known organic photoreceptors including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbazole; 4-dimethylaminobenzylidene; 2-benzylidene-amino-carbazole; (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; and mixtures thereof. Further, imaging members that can be selected are selenium and selenium alloys, zinc oxide, cadmium sulfide, hydrogenated amorphous silicon, as well as iongraphic surfaces of various dielectric materials such as polycarbonate polysulfone fluoropolymers, anodized aluminum alone or filled with wax expanded fluoropolymers, and the like.

The following examples are being supplied to further define specific embodiments of the present invention. These examples are intended to illustrate and not limit scope of the present invention. Parts and percentages are by weight unless otherwise indicated.

EXAMPLE I

A. Preparation of the Latex

Preparation of poly(N-vinyl-2-pyrrolidone-co-ethyl acrylate) sterically stabilized by poly(isobutylyene-co-isoprene) in isopar G Eighty grams of Kalene 800 was dissolved in 1,500 milliliters of isopar G. The resulting mixture was heated to 75° C. while being purged with nitrogen. Thereafter, 3.6 grams of azo 2,2-bisisobutyrlonitrile (AIBN) was then added to the resulting solution. After heating for 15 minutes, 36 milliliters of ethyl acrylate was added to the solution, and polymerization was allowed to proceed at 75° C. under constant stirring for an additional 3 hours. A clear solution of an amphipathic polymer of poly(isobutylene-co-isoprene-g-ethyl acrylate) was obtained. Subsequently, 15 grams of AIBN was then added to the resulting solution. After heating for an additional 15 minutes, 324 milliliters of ethyl acrylate was added to the solution and polymerization was allowed to proceed at 75° C. for a further 2 hours, and 7.5 grams of AIBN was then added to the solution, followed after an additional 15 minutes by the addition of 120 milliliters of N-vinyl-2-pyrrolidone. The reaction was allowed to proceed at 70° C. for a further 16 hours under constant stirring. Thereafter, 3 grams of AIBN was then added to the solution and the polymerization continued for a further 5 hours at 80° C. A latex with a 0.3 micrometer particle diameter was obtained as evidenced by light scattering. The solids content of the latex was about 30 percent by weight.

EXAMPLE II

Preparation of poly(vinyl acetate) latex sterically stabilized by poly(isobutylene-co-isoprene) in Isopar G One hundred grams of Kalene 800 was dissolved in 1,500 milliliters of Isopar G. The resulting mixture was heated to 75° C. while being purged with nitrogen. Subsequently, 3.6 grams of AIBN was added to the resulting solution. After heating for 15 minutes, 36 millileters of vinyl acetate was added to the solution and polymerization was allowed to proceed at 75° C. under constant stirring for an additional 3 hours. A clear solution of an amphipathic polymer of poly(isobutylene-co-isoprene-g-vinyl acetate) was obtained. Thereafter, 15 grams of AIBN was then added to the resulting solution. After heating for an additional 15 minutes, 440 milliliters of vinyl acetate was added to the resulting solution, and polymerization was allowed to proceed at 75° C. for a further 16 hours under constant stirring. A latex of 0.4 micron particle diameter was obtained as measured by using a Coulter Nanosizer light scattering instrument. The solids content of the latex was about 30 percent by weight.

EXAMPLE III

Preparation of poly(N-vinyl-2-pyrrolidone) latex sterically stabilized by poly(isobutylene-co-isoprene) in Isopar G One hundred-twenty grams of Kalene 800 was dissolved in 1,500 milliliters of Isopar G. The resulting mixture was heated to 75° C. while being purged with nitrogen. Subsequently, 3.6 grams of AIBN was added to the resulting solution. After heating for 15 minutes, 36 milliliters of N-vinyl-2-pyrrolidone was added to the solution and polymerization was allowed to proceed at 75° C. under constant stirring for an additional 3 hours. A clear solution of an amphipathic polymer of poly(isobutylene-co-isoprene-g-N-vinyl-2-pyrrolidone) was obtained. Thereafter, 15 grams of AIBN was added to the solution. After heating for an additional 15 minutes, 420 milliliters of vinyl acetate was added to the solution and polymerization was allowed to proceed at 75° C. for a further 12 hours under constant stirring. A latex of 0.4 micron particle diameter was obtained as measured by electron microscopy. The solids content of the latex was about 30 percent by weight.

EXAMPLE IV

Preparation of poly(ethyl)acrylate) latex sterically stabilized by poly(isobutylene-co-isoprene) in Isopar G Forty-eight grams of Kalene 800 was dissolved in 1,500 milliliters of Isopar G. The resulting mixture was heated to 75° C. while being purged with nitrogen. Subsequently, 3.6 grams of AIBN was added to the resulting solution. After heating for 15 minutes, 36 milliliters of ethyl acrylate was added to the solution and polymerization was allowed to proceed at 75° C. under constant stirring for an additional 3 hours. A clear solution of an amphipathic polymer of poly(isobutylene-co-isoprene-g-ethyl acrylate) was obtained. Thereafter, 15 grams of AIBN was added to the solution. After heating for an additional 15 minutes, 420, milliliters of ethyl acrylate was added to the solution and polymerization was allowed to proceed at 75° C. for a further 14 hours under constant stirring. A latex of 0.4 micron particle diameter was obtained as measured using a Coulter Nanosizer light scattering instrument. The solids content of the latex was about 30 percent by weight.

EXAMPLE V

Preparation of poly(N-vinyl-2-pyrrolidone-co-ethyl acrylate) latex sterically stabilized by poly(styrene-b-ethylenebutylene) in isopar G Forty-five grams of Kraton G-1701 was dissolved in 1,500 milliliters of isopar G. The resulting mixture was heated to 75° C. while being purged with nitrogen. Thereafter, 3.6 grams of AIBN was added to the resulting solution. After heating for 15 minutes, 36 milliliters of ethyl acrylate was added to the solution and polymerization was allowed to proceed at 75° C. under constant stirring for an additional 3 hours. A clear solution of an amphipathic polymer of poly(styrene-b-ethylene butylene-g-acrylate) was obtained. Subsequently, 15 grams of AIBN was added to the resulting solution. After heating for an additional 15 minutes, 324 milliliters of ethyl acrylate was added to the solution and polymerization was allowed to proceed at 75° C. for a further 2 hours. Seven and one half grams of AIBN was then added to the resulting solution followed, after an additional 15 minutes, by the addition of 120 milliliters of N-vinyl-2-pyrrolidone. The reaction was allowed to proceed to 70° C. for a further 16 hours under constant stirring. Three grams of AIBN was then added to the solution and polymerization continued for 5 hours at 80° C. A latex of 0.5 micrometer particle diameter was obtained as evidenced by light scattering. The solids content of the latex was about 30 percent by weight.

EXAMPLE VI

Preparation of poly(vinyl acetate) latex sterically stabilized by poly(styrene-b-ethylene butylene) block copolymer:

Fifty grams of Kraton G-1701 was dissolved in 1,500 milliliters of Isopar G. The resulting mixture was heated to 75° C. while being purged with nitrogen. Thereafter, 3.6 grams of AIBN was added to the resulting solution. After heating for 15 minutes, 36 milliliters of vinyl acetate was added to the solution and polymerization was allowed to proceed at 75° C. under constant stirring for an additional 3 hours. A clear solution of an amphipathic polymer of poly(isobutylene-co-isoprene-g-vinyl acetate) was obtained. Subsequently, 15 grams of AIBN was added to the resulting solution. After heating for an additional 15 minutes, 440 milliliters of vinyl acetate was added to the solution and polymerization was allowed to proceed at 75° C. for a further 16 hours under constant stirring. The solids content of the 0.3 microns diameter latex particle was found gravimetrically to be about 30 percent by weight.

EXAMPLE VII

Preparation of poly(vinyl acetate) latex sterically stabilized by poly(isobutylene-co-isoprene) in Parabase The latex polymerization process of Example II was repeated with the exception that Parabase was substituted for Isopar G. A latex of diameter 0.3 micron was obtained. The solids content of the latex was found to be about 30 percent by weight.

EXAMPLE VIII

Preparation of poly(N-vinyl-2-pyrrolidone-co-ethyl acrylate) latex sterically stabilized by poly(isobutylene-co-isoprene) in an Isopar G/Magiesol 60 mixture The latex particle polymerization process described in Example I was repeated with the exception that the Isopar G was replaced by a 60:40 weight percent mixture of Isopar G:Magiesol 60. A latex of a diameter of 0.25 micron was obtained whose solid content was about 30 percent by weight.

EXAMPLE IX

Preparation of poly(N-vinyl-2-pyrrolidone-co-ethyl acrylate) latex sterically stabilized by a poly(styrene-b-ethylene butylene) block copolymer in an Isopar G/Magiesol 60 mixture;

The latex particle polymerization process described in Example V was repeated with the exception that Isopar G was replaced by a 70:30 weight percent mixture of Isopar G:Magiesol 60. A latex of a diameter of 0.5 micron was obtained whose solid content was about 30 percent by weight.

B. DYEING OF THE LATEX

The solid content of the above prepared latexes was adjusted to about 10 percent by weight by the addition of about 200 milliliters of Isopar G to 100 milliliters of the latex. A methanol solution containing 2 to 5 grams of a dye or dye mixture dissolved in 20 milliliters of absolute methanol was filtered through a Whatman No. 4 filter paper. The filtered dyed methanol solution was then added drop wise to the latex with constant stirring thereby forming an emulsion. The dyed methanol solution was imbibed or absorbed into the polymer latex at 60° C. over a period of 3 hours after which the methanol was removed by distillation under a reduced pressure of 2 Torr and the resulting dyed latex filtered through a 45 micron wire sieve to remove any unwanted material resulting in a nonaggregated dispersion of dyed latex particles in the oil vehicles as illustrated in Table 1.

TABLE 1

| Dyed Particle Component | Latex Example Number | Dye or Dye Mixture Used | Color |
|---|---|---|---|
| B1 | I* | 4.0 g Orasol Red G | Magenta |
| B2 | I | 4.0 g Orasol Blue 2GLN | Cyan |
| B3 | I | 4.0 g Orasol Yellow 2GLN | Yellow |
| B4 | I | 1.4 g Orasol Blue 2GLN, 1.0 g Orasol Red G, 1.0 g Orasol Yellow 2GLN, 0.6 g Orasol Black 2L | Black |
| B5 | II | 4.0 g Neozapon Black X57 | Black |
| B6 | III | 4.0 g Orasol Red G | Magenta |
| B7 | IV | 4.0 g Orasol Blue 2GLN | Cyan |
| B8 | V | 2.0 g Orasol Blue 2GLN, 2.0 g Orasol Yellow 2GLN | Green |
| B9 | V | 2.6 g Orasol Blue 2GLN, 1.2 g Orasol Red G | Blue |
| B10 | V | 2.8 g Orasol Red G, 1.1 g Orasol Yellow 2GLN | Red |
| B11 | V | 1.5 g Savinyl Black RLS, 1.5 g Savinyl Red 3BLS, 0.9 g Savinyl Yellow 2RLS | Black |
| B12 | VI | 4.0 g Orasol Yellow 2GLN | Yellow |
| B13 | VII | 4.0 g Orasol Blue 2GLN | Cyan |
| B14 | VIII | 4.0 g Morfast Blue 100 | Cyan |
| B15 | IX | 4.0 g Orasol Red G | Magenta |

*The latex as formulated by the process of Example I.

C. PREPARATION OF CONDUCTIVE LIQUID DEVELOPERS 1 TO 18 AND IMAGING PERFORMANCE

For preparation of liquid developers, the dyed latexes of Table 1 were concentrated to about 25 percent by weight of solids by removal of the Isopar under reduced pressure at which time a polymeric thickener, such as ECA 4600, Vistanex LM-MS, or Kalene 800 was added as a solution in a base oil vehicle such as Magiesol. The excess Isopar G was then further removed under reduced vacuum until a developer of 200 to 300 centipoises was obtained. It was found that the resistivity of the materials prepared in this manner enabled developers with a resistivity window of $10^9$ to $10^{11}$ ohm-cm, thus no conductivity aids were necessary. Details of the above developers, their physico-chemical characteristics, and their imaging performance are provided in Table 2. The proportions of each component are calculated (in brackets) on a weight percentage basis.

Subsequently, each of the prepared developers 1 to 18 were incorporated into a xerographic imaging test fixture containing a layered imaging member comprised of an aluminum substrate, a photogenerating layer of trigonal selenium, 90 percent by weight, dispersed in 10 percent by weight of polyvinyl carbazole; and a charge transport layer containing N,N'-diphenyl-N,N-bis(3-methylphenyl) 1,1'-biphenyl-4,4'-diamine molecules, 55 percent by weight, dispersed in 45 percent by weight of the polycarbonate resinous binder Makrolon, which member has been negatively charged. The latent image on the layered member was curtailed with the developer composition utilizing a gravure roll, wherein the developers are attracted to the latent image by the application of an electric field of about 1,000 volts/cm. Subsequently, the developed images are electrostatically transferred to paper. Fixing or drying time refers to the time period within which the images are permanently fixed to the paper. Also, the optical densities were determined by measurement with a Macbeth Densitometer in the reflection mode. Optical densities in excess of 1.0 for black and 0.8 for color indicate that the resulting images possessed excellent solid area coverage.

As an alternative to using polymers such as Kalene 800, Vistanex LM-MS, ECA 4600 and Kraton G-1701 as thickeners, inorganic pigment thickeners may be selected. This allows for a reduction in the polymer concentration. This is usually accomplished by ball milling the inorganic pigment, such as Aerosil 200 or Bentone 500, with a polymeric thickener in the base oil to be used, for example Magiesol 60. Examples of such inks (developer compositions) and the characteristics thereof are provided in Table 3.

TABLE 2

| Developer No. | Dyed Particle Component | Vehicle | Thickener | Viscosity/ Centipoise | Resistivity/ Ohm-cm | Drying Time/ Seconds | Optical Density (Color) |
|---|---|---|---|---|---|---|---|
| 1 | B1(18%) | Magiesol 60 (59%) | ECA 4600 (23%) | 284 | $2.8 \times 10^{10}$ | 30 | 1.1 (Magenta) |
| 2 | B2(24%) | Magiesol 60 (52%) | ECA 4600 (24%) | 290 | $2.3 \times 10^{10}$ | 30 | 1.2 (Cyan) |
| 3 | B3(18%) | Magiesol 60 (60%) | ECA 4600 (22%) | 233 | $5 \times 10^{10}$ | 25 | 1.0 (Yellow) |
| 4 | B4(20%) | Magiesol 60 (62%) | ECA 4600 (18%) | 196 | $4 \times 10^{10}$ | 15–20 | 1.2 (Black) |
| 5 | B4(20%) | Magiesol | ECA 4600 | 180 | $4 \times 10^{10}$ | 10–15 | 1.2 |

TABLE 2-continued

| Developer No. | Dyed Particle Component | Vehicle | Thickener | Viscosity/ Centipoise | Resistivity/ Ohm-cm | Drying Time/ Seconds | Optical Density (Color) |
|---|---|---|---|---|---|---|---|
| | | 60/Isopar G 50:50 Mixture (62%) | (18%) | | | | (Black) |
| 6 | B4(38%) | Magiesol 60 (58%) | ECA 4600 (4%) | 341 | $2.3 \times 10^{10}$ | 50 | 1.2 (Black) |
| 7 | B4(23%) | Magiesol 60 (68%) | Vistanex LM-MS (9%) | 400 | $2.3 \times 10^{10}$ | 50 | 1.2 (Black) |
| 8 | B5(18%) | Magiesol 60/Isopar G 50:50 Mixture (74%) | Kalene 800 (8%) | 220 | $3 \times 10^{10}$ | 15 | 1.0 (Black) |
| 9 | B6(10%) | Magiesol 60/Parabase 50:50 Mixture (70%) | Kalene 800 (10%) | 245 | $4 \times 10^{10}$ | 20 | 1.0 (Magenta) |
| 10 | B7(16%) | Magiesol 60 (66%) | ECA 4600 (18%) | 202 | $3 \times 10^{10}$ | 15–20 | 0.9 (Cyan) |
| 11 | B8(17%) | Magiesol 60 (81%) | Kraton G-1701(2%) | 281 | $4.5 \times 10^{10}$ | 20 | 1.1 (Green) |
| 12 | B9(17%) | Magiesol 60 (81%) | Kraton G-1701(2%) | 275 | $4.5 \times 10^{10}$ | 20 | 1.0 (Blue) |
| 13 | B10(17%) | Magiesol 60 (81%) | Kraton G-1701(2%) | 278 | $4.5 \times 10^{10}$ | 25 | 1.1 (Red) |
| 14 | B11(17%) | Magiesol 60 | Kraton G-1701(2%) | 270 | $4.3 \times 10^{10}$ | 25 | 1.1 (Black) |
| 15 | B12(20%) | Magiesol 60/Isopar G 30:70 Mixture (79%) | Kraton G-1701 (1%) | 205 | $4.1 \times 10^{10}$ | 10 | 0.9 (Yellow) |
| 16 | B13(18%) | Parabase (62%) | ECA 4600 (20%) | 210 | $3.2 \times 10^{10}$ | 15 | 1.0 (Cyan) |
| 17 | B14(23%) | Magiesol 60 (71%) | Vistanex LM-MS (6%) | 232 | $3.8 \times 10^{10}$ | 20 | 1.0 (Cyan) |
| 18 | B15(33%) | Paraflex HT-10 (75%) | Kraton G-1701 (1%) | 228 | $4.3 \times 10^{10}$ | 20 | 1.0 (Magenta) |

TABLE 3

| Dyed Particle No. | Vehicle | Polymer Thickener | Inorganic Pigment Thickener | Viscosity/ Cp | Resistivity/ ohm cm | Drying Time/ Seconds | Optical Density |
|---|---|---|---|---|---|---|---|
| B4(23%) | Magiesol 60 (73%) | Vistanex LM-MS (2%) | Aerosil 200 (2%) | 400 | $1.8 \times 10^{10}$ | 30 | 1.1 (Black) |
| B7(16%) | Magiesol 60 (73%) | ECA 4600 (9%) | Aerosil 200 (2%) | 230 | $2 \times 10^{10}$ | 20 | 0.9 (Cyan) |
| B14(23%) | Magiesol 60 (73%) | Vistanex LM-MS (2%) | Bentone 500 (2%) | 250 | $3 \times 10^{10}$ | 20 | 1.0 (Cyan) |

Other modifications of the present invention will occur to those skilled in the art based upon a reading of the present disclosure. These are intended to be included within the scope of this invention.

What is claimed is:

1. A conductive colored liquid developer composition comprised of an insulating oil base, a stabilized polymer latex component with imbibed molecularly dispersed colored dye components, said polymer latex component and dye components being of a neutral polarity, and a thickener compatible with the stabilizer selected for the latex, said liquid developer having a conductivity of from about $10^9$ to about $10^{11}$ (ohm-cm)$^{-1}$ and a viscosity of from about 100 to about 3,000 centipoise.

2. A colored composition in accordance with claim 1 wherein the oil base is comprised of a mixture of Magiesol, Isopar, Paraflex HT-10, Shellflex 2210, Parabase, and Witsol 50.

3. A colored composition in accordance with claim 1 wherein the oil base is Magiesol.

4. A colored composition in accordance with claim 1 wherein the oil base is Magiesol 60.

5. A colored composition in accordance with claim 4 wherein the Magiesol 60 is present in an amount of from about 40 percent by weight to about 60 percent by weight.

6. A colored composition in accordance with claim 1 wherein the polymer latex is poly(vinyl pyrrolidone-co-ethyl acrylate).

7. A colored composition in accordance with claim 1 wherein the latex is stabilized with polyisobutylene.

8. A colored composition in accordance with claim 1 wherein the latex is stabilized with a poly(styrene-b-ethylene butylene) block copolymer.

9. A colored composition in accordance with claim 1 wherein the thickener is polyisbutylene or polystyrene-b-ethylene butylene.

10. A colored composition in accordance with claim 1 wherein the dye is selected from the group consisting of magenta, cyan, yellow, and mixtures thereof.

11. A colored composition in accordance with claim 1 wherein the dye is comprised of a mixture of cyan, magenta and yellow enabling a black developer composition.

12. A colored composition in accordance with claim 1 wherein the dye is selected from the group consisting of red, blue, green and yellow.

13. A conductive colored liquid developer composition comprised of an insulating oil base selected from the group consisting of Magiesol, Isopar, and mixture thereof; a latex component of poly(vinyl pyrrolidone), sterically stabilized with a soluble polymer and having imbibed therein molecularly dispersed colored pigment particles selected from the group consisting of cyan, magenta, yellow, and mixtures thereof, said latex component and pigment particles being of a neutral polarity; and a thickener, said liquid developer having a conductivity of from about $10^9$ to about $10^{11}$ (ohm-cm)$^{-1}$ and a viscosity of from about 100 to about 3,000 centipoise.

14. A developer composition in accordance with claim 13 wherein the oil base is comprised of from about 70 percent by weight to about 30 percent by weight of Magiesol, and from about 30 percent by weight to about 70 percent by weight of Isopar.

15. A developer composition in accordance with claim 14 wherein Isopar G, H, K, L or M is selected.

16. A developer composition in accordance with claim 13 wherein the latex is stabilized with polyisobutylene.

17. A developer composition in accordance with claim 13 wherein the latex is stabilized with a poly(styrene-b-ethylene butylene) block copolymer.

18. A developer composition in accordance with claim 13 wherein the thickener is polyisobutylene.

19. A developer composition in accordance with claim 13 wherein the drying time of the developer is from about 5 seconds, to about 20 seconds.

20. A composition in accordance with claim 13 wherein lsopar is selected, thereby enabling use of the resulting developer with dielectric papers.

21. A method for the development of images which comprises the formation of an image on a photoreceptor surface, thereafter contacting this image with the liquid developer composition of claim 1 by means of a conductive development process, subsequently transferring the image to a suitable substrate, and permanently affixing the image thereto.

22. A method of imaging in accordance with claim 21 wherein the drying time of the resulting image is from about 10 to about 60 seconds.

23. A method of imaging in accordance with claim 21 wherein there is selected for the developer as the oil base Magiesol 60.

24. A method of imaging in accordance with claim 21 wherein the latex selected for the developer is stabilized with poly(vinyl pyrrolidone-co-ethyl acrylate).

25. A method of imaging in accordance with claim 21 wherein the latex selected for the developer is stabilized with a poly(styrene-b-ethylene butylene) block copolymer.

26. A method of imaging in accordance with claim 21 wherein the thickener for the developer is polyisobutylene or polystyrene-b-ethylen ebutylene.

27. A method for the development of images which comprises the formation of an image on a photoreceptor surface, thereafter contacting this image with the liquid developer composition of claim 13 by means of a conductive development process, subsequently transferring the image to a suitable substrate, and permanently affixing the image thereto.

28. A developer composition in accordance with claim 27 wherein the latex is stabilized with polyisobutylene.

29. A developer composition in accordance with claim 27 wherein the latex is stabilized with a poly(styrene-b-ethylene butylene) block copolymer.

30. A colored composition in accordance with claim 1 wherein the solids content is from about 5 to about 50 percent by weight.

31. A colored composition in accordance with claim 13 wherein the solids content is from about 5 to about 50 percent by weight.

* * * * *